US005613890A

United States Patent [19]

DeMars

[11] Patent Number: 5,613,890

[45] **Date of Patent: *Mar. 25, 1997**

[54] MOTORIZED BUBBLE MAKING AND PROPELLING TOY GUN WITH LATERAL WIPER

[76] Inventor: Robert A. DeMars, 5000 N. Parkway Calabasas - Ste. 225, Calabasas, Calif. 91302

[ * ] Notice: The term of this patent shall not extend beyond the expiration date of Pat. No. 5,498,191.

[21] Appl. No.: 541,309

[22] Filed: Oct. 10, 1995

Related U.S. Application Data

[63] Continuation-in-part of Ser. No. 391,104, Feb. 21, 1995, Pat. No. 5,498,191.

[51] Int. Cl.[6] ..... A63H 33/28; A63H 33/30

[52] U.S. Cl. ..... 446/15; 446/473; 446/475

[58] Field of Search ..... 446/15, 16, 17, 446/18, 19, 20, 21, 176, 178, 473, 475, 483, 489; 222/78

[56] References Cited

U.S. PATENT DOCUMENTS 2,393,039 1/1946 Gilchrist .
2,974,438 3/1961 Hopkins .
2,989,818 6/1961 Filger .
4,423,565 1/1984 Bart .
5,224,893 7/1993 Routzong .

FOREIGN PATENT DOCUMENTS 5285278 11/1993 Japan .

*Primary Examiner*—Robert A. Hafer
*Assistant Examiner*—D. Neal Muir
*Attorney, Agent, or Firm*—Jack C. Munro

[57] ABSTRACT

A hand holdable bubble producing toy that, when activated by the user, produces a stream of bubbles. Activation of the toy is accomplished by manually moving of a trigger which electrically operates a fan and a pump, as well as a manual film producing mechanism in order to produce and dispense bubbles. The toy includes a collection system for recycling excess bubble solution and structure for supplying supplemental air for disbursement of bubbles blown.

7 Claims, 3 Drawing Sheets

MOTORIZED BUBBLE MAKING AND PROPELLING TOY GUN WITH LATERAL WIPER

REFERENCE TO PRIOR APPLICATION

This application is a continuation-in-part of United States patent application Ser. No. 08/391,104 now U.S. Pat. No. 5,498,191, filed Feb. 21, 1995, by the present inventor, now U.S. Pat. No. 5,498,191.

BACKGROUND OF THE INVENTION

1) Field of the Invention

The field of this invention relates to toys and more particularly to a hand holdable toy to be normally used by a child that dispenses a stream of air bubbles from a liquid such as a soap solution.

2) Description of the Prior Art

Trigger actuated toys, generally in the form of a pistol or rifle, are in exceedingly common usage. Normally such toys are used to propel an object. It is quite common to design this object to be capable of not causing injury. Common forms of non-injury types of objects would be corks, plastic slugs and water. Another form of a non-injury propelable object would be a soap bubble.

Bubble producing toys in the form of a pistol or rifle have been previously known. Reference is to be had to a similar type of toy which was filed by the present inventor in a U.S. patent application Ser. No. 08/391,104, now U.S. Pat. No. 5,498,191, filed Feb. 21, 1995 entitled BUBBLE PRODUCING TOY. Also reference is to be had to prior art similar types of toys in the U.S. Pat. Nos. 2,393,039; 2,974,438; 2,989,818; 4,423,565 and 5,224,893. Also reference is to be had to a similar type of toy in a Japanese patent 5-285278. All these prior references, excepting application No. U.S. Pat. No. 5,498,191, are directed to bubble producing toys which utilize some form of a member that dips into a bubble solution and when extracted, can be used to produce a bubble. The bubble is normally produced by blowing air at the dip member with the dip member having a hole therein with the soap film being produced across the hole after it is removed from a soapy solution. The structure described within applicant's co-pending patent application is basically similar to the structure of the present invention in that no member is dipped into a bubble solution and extracted therefrom and then subjected to an air stream. A bubble film in the form of a thin membrane is produced across an aperture by means of a wiper bar with this film being reproduced rapidly which thereby produces bubbles rapidly.

The structure of the present invention is different from the prior invention of applicant as defined within U.S. patent application U.S. Pat. No. 5,498,191 in that the structure of the present invention includes a substantially decreased number of parts. The volume of air flow of the bubble producing toy of the present invention can be varied which is not possible within the prior application. A varying air flow is desirable in that generally the greater the air flow, the smaller in size the bubbles that are produced. Decreasing the air flow from a maximum air flow level will normally result in the production of larger sized bubbles. The structure of the present invention includes an improved wiper bar arrangement over that of prior U.S. Pat. No. 5,498,191. There is also included within the present invention an improved check valve over prior U.S. Pat. No. 5,498,191 to prevent spilling of the bubble solution upon turning over of the bubble producing toy of the present invention.

SUMMARY OF THE INVENTION

The bubble producing toy of the present invention is located within a hand holdable housing which includes a manually movable trigger. Within the internal chamber of the housing there is located a battery driven electrical motor attached to a fan which is activated by operation of the trigger. The trigger also activates a film producing mechanism in the form of a wiper bar with this activation occurring subsequent to the activation of the electrical motor. Operation of the motor activates a pump which causes movement of the bubble solution to the wiper bar in order to create the film across an opening within the dispensing sleeve. It is the function of the wiper bar to create a thin film of liquid across the face of the sleeve as the wiper bar is moved relative to the sleeve. The trigger operation also causes the air created by the fan to be moved through the sleeve into the film resulting in the producing of bubbles. The sleeve is mounted within an opening of the housing which connects to the ambient.

One of the primary objectives of the present invention is to construct a bubble producing toy which is constructed of few parts and therefore can be manufactured at a substantially decreased cost from the bubble producing toys of the prior art.

Another objective of the present invention is to construct a bubble producing toy where the air flow through the toy can be varied in order to vary the size of soap bubbles that are produced by the toy.

Another objective of the present invention is to utilize a wiper bar that moves laterally as opposed to vertically therefore working with gravity, rather than against gravity, in order to produce a more consistent film production from which the bubbles are produced.

DETAILED DESCRIPTION OF THE PREFERRED EMBODIMENT

A bubble is defined as a small globule of gas in a thin liquid envelope. Children and others have long used a liquid solution to produce bubbles. A common form of such a liquid solution is water combined with a detergent or soap. The detergent or soap lowers the surface tension of the water permitting a small quantity of a liquid to be stretched across an enclosing device such as a ring forming a film. When air is propelled into this film, the film breaks free of the ring and encloses a quantity of the air producing a bubble. Although soapy water has been found to be desirable for such a liquid, other liquids could be utilized or water combined with other substances such as glycerin. However, one function of glycerin is for the purpose of extending the life of any produced air bubble.

Figure 1:
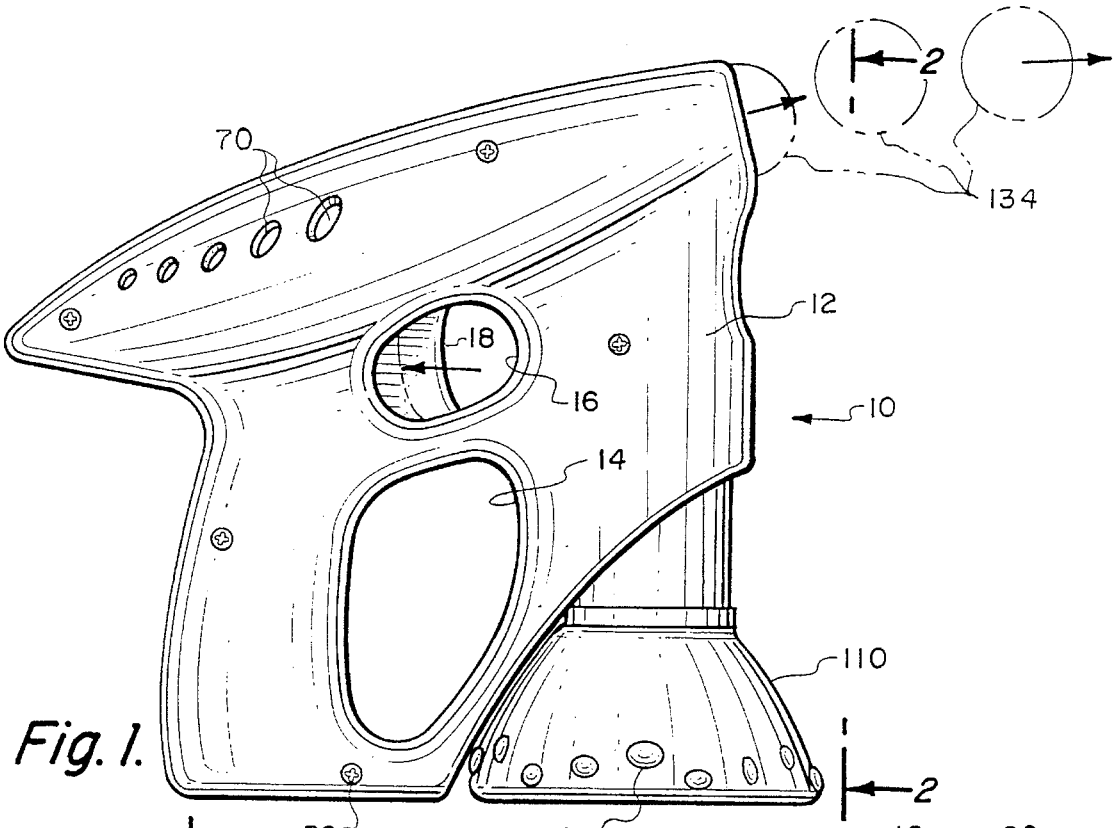
FIG. 1 is a side elevational view of the bubble producing toy of the present invention depicting dispensing of a series of bubbles.
Figure 2:
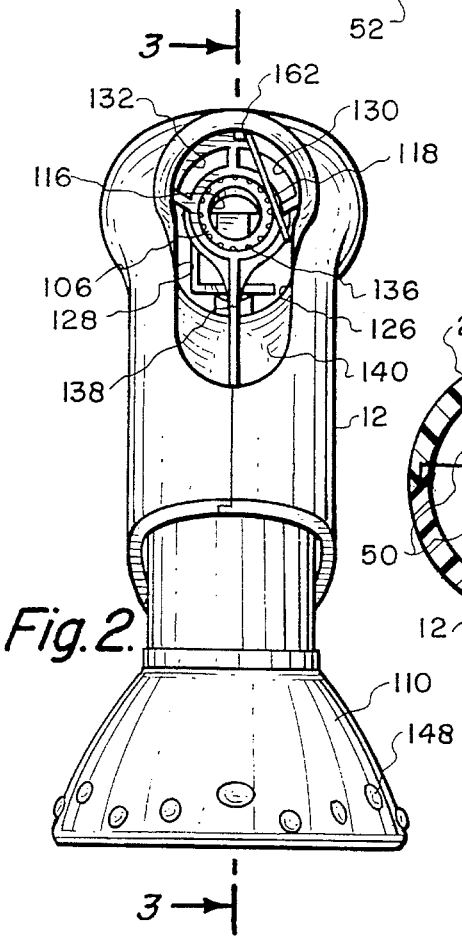
FIG. 2 is a front view of the bubble producing toy of the present invention taken along line 2—2 of FIG. 1.
Figure 3:
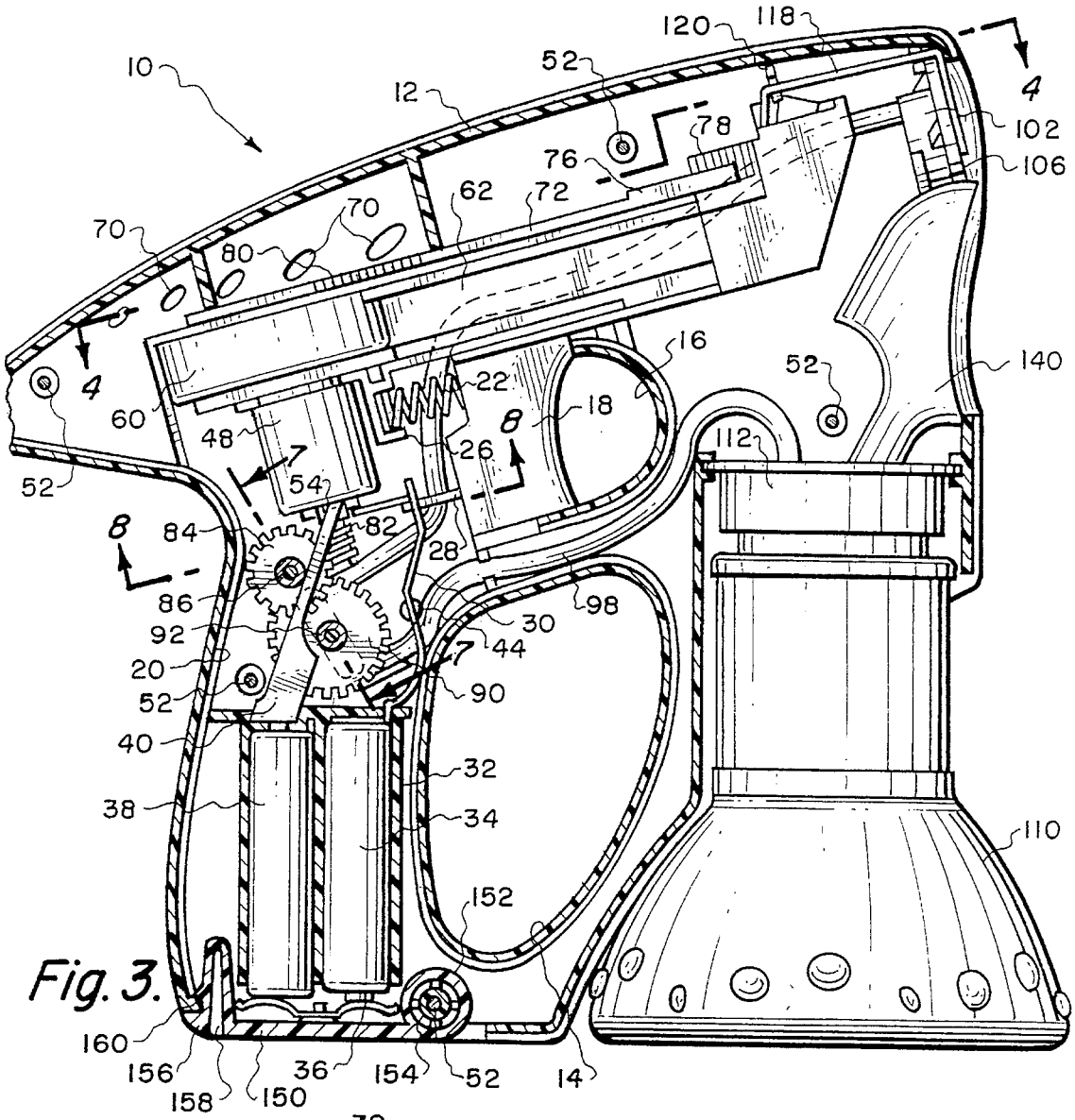
FIG. 3 is a longitudinal cross-sectional view of the bubble producing toy of the present invention taken along line 3—3 of FIG. 2 showing the toy in the inactivated position.
Figure 4:
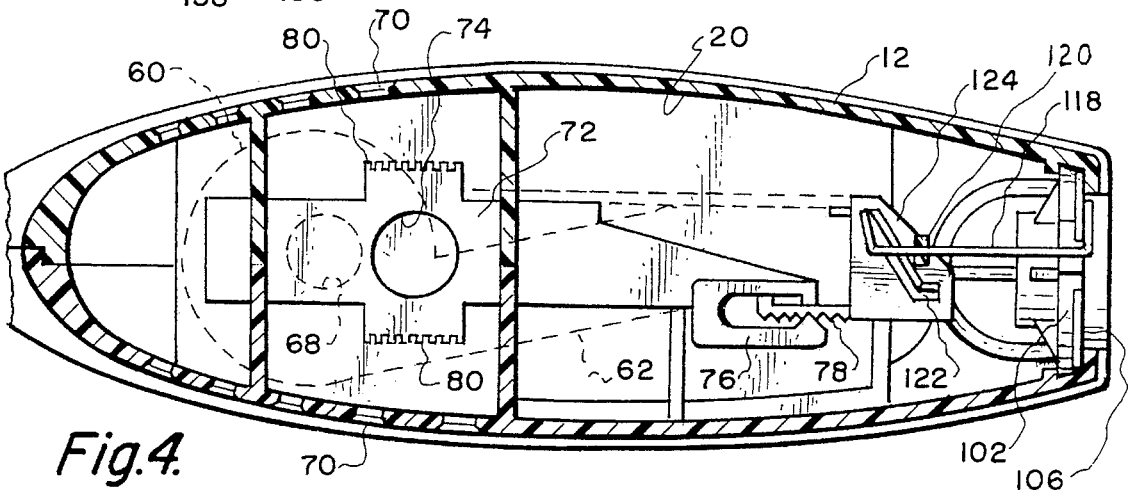
FIG. 4 is a cross-sectional view taken along line 4—4 of FIG. 3 showing more clearly the mechanism utilized within the bubble producing toy of the present invention to control the volume of external air into the toy that is to be moved by the fan within the toy with this control being in the closed position not permitting flow of air through the toy.
Figure 5:
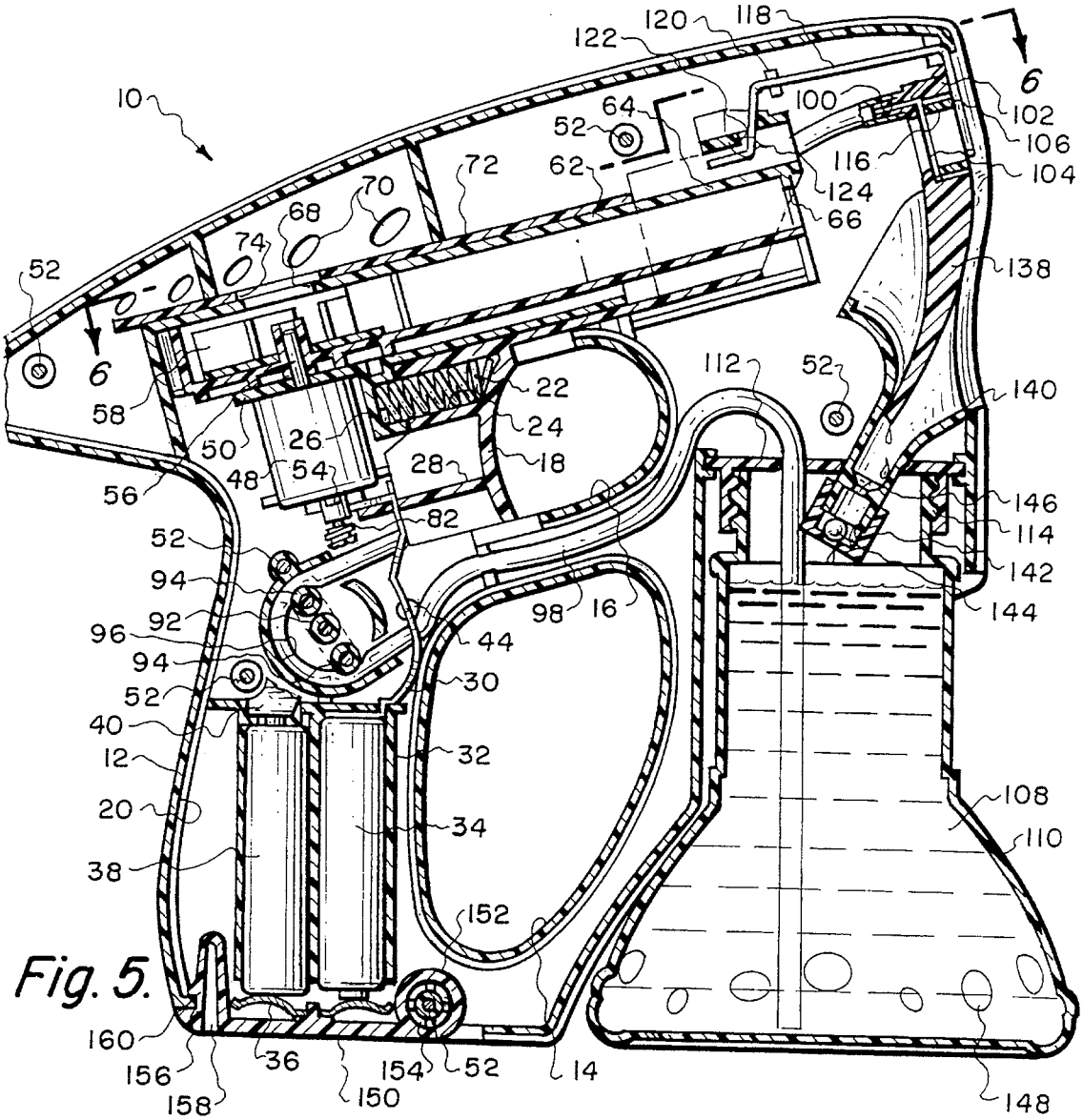
FIG. 5 is a cross-sectional view similar to FIG. 3 showing in more detail the parts of the bubble producing toy of the present invention and also showing the toy in the activated position.

Referring particularly to the drawings, there is shown the bubble producing toy 10 of this invention. The bubble producing toy 10 includes an exterior sheet material plastic housing 12 which includes an enlarged opening 14 and a trigger opening 16. The user, when holding the toy 10 of this invention, would normally place the palm of the user's hand (not shown) against the housing with the fingers of the hand being located within the enlarged opening 14 and the forefinger being located within the trigger opening 16. The thumb of the hand is to be located against the side of the housing opposite the location of the palm (not shown). Movably mounted in the trigger opening 16 is a lineally movable trigger 18. Housing 12 includes an internal chamber 20. The trigger 18 is movably mounted against the bias of a coil spring 22. One end of the coil spring 22 is located within cavity 24 against the lineally movable trigger 18. The other end of the coil spring 22 abuts against a wall 26 which is integrally mounted on the interior surface of the housing 12. The trigger 18 is shown in its normally inactivated position in FIGS. 1 and 3 and in its maximum moved activated position in FIG. 5.

Integrally mounted on the trigger 18 is a hook member 28. With the trigger 18 in the inactivated position, the hook member 28 connects with electrical contact 30. The upper end of electrical contact 30 has a natural spring bias. Electrical contact 30 comprises an elongated thin metallic member, the lower end of which is fixedly mounted to battery housing 32 and is to be in physical contact with the negative pole of battery 34 mounted within the battery housing 32. The positive pole of the battery 34 is in contact with a second electrical contact 36 fixed in the door 150. This second electrical contact 36 is electrically in contact in series with the negative pole of a second battery 38 with the positive pole of the second battery 38 being in contact with a third contact 40. The upper end of the electrical contact 30 includes a V-shaped groove 42. The electrical contact 30 is mounted for support within a slot formed within a pin 44 which is integrally mounted on the interior wall surface of the housing 12. With the trigger 18 in the inactivated position, the hook member 28 pulls against the bias of the electrical contact 30 and locates the V-shaped groove 42 spaced from terminal 46 of a motor 48. The motor 48 is mounted on wall 50 which is integral with the housing 12 and is located within the internal chamber 20. The wall 50 is actually composed of two parts, one part being mounted on one portion of the housing 12 and the other part located on the other portion of the housing 12. It is to be understood that the housing 12 is actually composed of a right half and a left half which are to be connected together after all parts are assembled within the internal chamber 20. The right half and left half will be connected together by appropriate screw fasteners 52.

The natural spring bias of electrical contact 30 tends to locate the V-shaped groove 42 in direct contact with terminal 46. Therefore, when the trigger 18 is activated and moved against the bias of the coil spring 22, the hook member 28 will also move a short distance which will result in the spring bias of the electrical contact 30 moving its V-shaped groove 42 to contact the terminal 46. Electrical energy from the batteries 34 and 38 will then be conducted through the third contact 40 which is also directly connected to a second terminal 54 of the motor 48. Therefore, the motor 48 will be electrically operated.

Starting of the motor 48 causes rotation of output shaft 56. Mounted on the output shaft 56 is a fan blade assembly 58. The fan blade assembly 58 is mounted within a fan housing 60. Connected to the fan housing 60 is an outlet tube 62. This outlet tube 62 is mounted at an angle of about twenty degrees relative to the longitudinal center axis of the housing 12. The outlet tube 62 has an outer end 64 which terminates in a discharge opening 66. Mounted within the outlet tube 62 is an outside air inlet opening 68. External air is to be conducted through the holes 70 formed within the housing 12 to within the internal chamber 20. This external air is to be moved by the fan blade assembly 58 to be propelled within the outlet tube 62. It is to be understood that the outlet tube 62 is formed integral with the housing 12. The air is to be propelled out through discharge opening 66 of the outlet tube 62.

Figure 6:
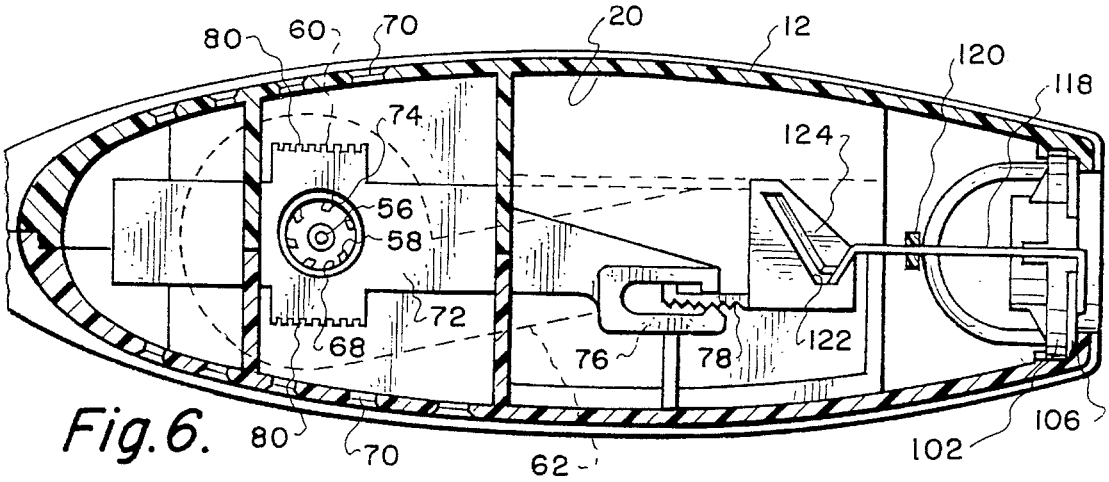
FIG. 6 is a view similar to FIG. 4, taken along line 6—6 of FIG. 5, showing the toy in a position permitting maximum air flow through the toy.

The amount of external air that enters the inlet openings 68 can be varied. This variance is achieved by a volume control mechanism in the form of a plate 72 which is mounted against the tube 62 and the fan housing 60. The plate 72 includes a hole 74. Plate 72 also includes a slidable hook member 76. This slidable hook member 76 connects with serrated plate 78 which is integrally connected to the trigger 18. The slidable hook member 76 can be lineally adjusted on the serrated plate 78. As the trigger 18 is moved, the plate 72 and the hole 74 are also moved because of the connection between the hook member 76 and the serrated plate 78. Movement will result in the hole 74 being moved from a non-aligned position to a partially aligned position with the external air inlet opening 68. This will then permit external air to be moved by the fan blade assembly 58 into the outlet tube 62 having entered outlet tube 62 through holes 70,74 and 68. Hole 74 and thus the volume of external air can be varied by varying the position of the slidable hook member 76 on the serrated plate 78. This variation is obtained by adjusting the position of the plate 72 by inserting of a tool, such as a screw driver (not shown), through one of the holes 70 to connect with ridges 80 formed on the plate 72. By exerting of manual force with this tool against the ridges 80, the slidable hook member 76 can be moved longitudinally to a different position on the serrated plate 78 thereby increasing or decreasing the amount of external air that is being conducted through said hole 74 and into the air inlet opening 68. It is to be understood that within FIG. 6, the hole 74 is shown to be concentric with the air inlet opening 68. In actual practice this will probably never occur since in most instances it will probably not be desirable to have the maximum volume of external air being conducted into the fan housing 60 and hence to be dispensed through tube 62 to the discharge opening 66.

Figure 7:
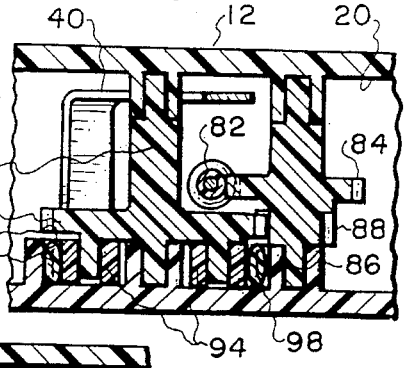
FIG. 7 is a cross-sectional view taken along line 7—7 of FIG. 3 showing in more detail the gearing arrangement used to produce the pumping of the soapy liquid within the toy of the present invention.
Figure 8:
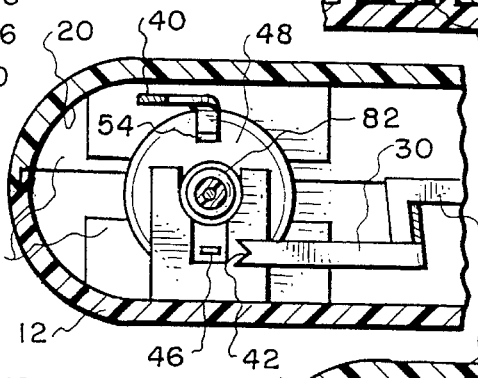
FIG. 8 is a cross-sectional view taken along line 8—8 of FIG. 3 showing the electrical contact arrangement in conjunction with the motor with the motor not activated.
Figure 9:
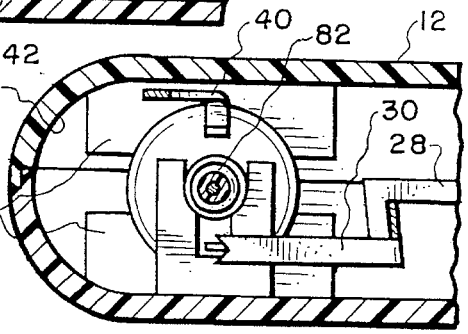
FIG. 9 is a view similar to FIG. 8 but showing the motor being activated.

The motor 48 also drives a worm gear 82. The worm gear 82 is in continuous contact with a spur gear 84. The spur gear 84 is pivotally mounted on the housing 12. For purposes of clearly understanding the gearing arrangement, the worm gear 82 is shown in FIG. 7 which would actually not be shown by the section line 7—7 in FIG. 3. Rotation of the spur gear 84 rotates spur gear shaft 86. Also mounted on the spur gear shaft 86 is a much smaller in diameter spur gear 88. Engaged with the spur gear 88 is an enlarged spur gear 90. The enlarged spur gear 90 is mounted on enlarged spur gear shaft 92 which is also rotationally mounted on the housing 12. Mounted on the enlarged spur gear 90 is a pair of rollers 94. The rollers 94 are mounted within peristaltic pump chamber 96. Peristaltic pump chamber 96 is fixed to housing 12. A portion of a tube 98 is to be located against the wall of the peristaltic pump chamber 96.

Rotation of the gear 90 causes rollers 94 to pinch off the tube 98 against the wall of the peristaltic pump chamber 96. Any liquid that enters from the bottle 110 and contained within the tube 98 is thereupon moved forward to be discharged in the passage 100 into an annular chamber 104 formed within the sleeve 102. From the annular chamber 104 the liquid is dispensed through a series of capillary openings 136 on the outer surface 106 (or dispensing surface) of a sleeve 102. The liquid 108 is to comprise a soapy solution contained within a bottle 110. One end of the tube 98 extends within the bottle 110 and is submerged in the liquid 108. The tube 98 is fixedly conducted through a cap 112 which is fixedly mounted to the housing 12. The cap 112 is internally threaded so as to engage with the threaded end 114 of the bottle 110. A small amount of this liquid 108 is pumped to the outer surface 106 and is stretched across the opening 116 of the sleeve 102 by means of a wiper bar 118. This wiper bar 118 is formed to have a slight spring bias which constantly presses the wiper bar 118 into continuous contact with the outer surface 106. The wiper bar 118 is pivotally mounted onto the housing 12 by means of mount 120. The inner end of the wiper bar 118 is mounted within slot 122 formed within a plate 124. Plate 124 is integrally mounted on the serrated plate 78.

Therefore, it is to be understood that movement of the trigger 18 will cause the wiper bar 118 to be moved within the slot 122. This will result in the outer end of the wiper bar 118 to be laterally moved back and forth across the outer surface 106 to produce a film (not shown) across the opening 116. A portion of the air that is being moved through the tube 62 and discharged through discharge opening 66 is discharged into the ambient through the opening 116, thereby dislodging the wiper-produced soapy film spread across opening 116 producing soap bubbles 134. During operation of the bubble producing toy 10 of this invention, the wiper bar 118 will be laterally moved rapidly back and forth across the outer surface 106 producing film from fluid exiting capillary openings 136 with the net result that a constant steady stream of the bubbles 134 will be produced from the film and blown air.

Not only is air propelled through the opening 116, but air is also propelled through openings 126, 128, 130 and 132 which surround the sleeve 102. The air from the openings 126, 128, 130 and 132 function to propel outwardly the bubbles 134 after such are formed. It is to be noted that the sleeve 102 includes a plurality of the capillary openings 136 which are located in a concentric arrangement into the sleeve 102 about the opening 116. The liquid 108 is to be conducted through these capillary openings 136 to be dispensed on the outer surface 106 for the action of the wiper bar 118.

Excess liquid 108 from the outer surface 106 is permitted to flow onto a drip bar 138. This liquid from the drip bar 138 is deposited within funnel 140. The outlet of the funnel 140 extends through the cap 112 and therefore functions to return the excess liquid 108 from the outer surface 106 back into the bottle 110. Mounted on the outer end of the funnel 140, and located interiorly of the cap 112, is a check ball cage 142. Within the check ball cage 142 is located a ball check valve 144. During normal operation of the bubble producing toy 10 of this invention, the unused excess liquid 108 is free to pass the ball check valve 144 to reenter the bottle 110. However, if the bubble producing toy 10 of this invention is turned upside down, the ball check valve 144 will be moved against orifice 146 of the funnel 140, closing such, and not permitting any of the liquid 108 to be discharged back into the funnel 140 or to leak.

It is to be understood that any suitable flat based bottle 110 could be utilized. The bottle 110, that is shown in the drawings, has an enlarged base for upright stability which includes protuberances 148 for ornamentation.

The operation of the bubble producing toy 10 of this invention is as follows: Let it be assumed that the bottle 110 which contains liquid 108 is connected to the cap 112. Batteries 34 and 38 are installed. The user begins to move trigger 18 which will immediately result in the V-shaped groove 42 contacting the terminal 46 establishing an electrical connection between third contact 40 and electrical contact 30 and hence across terminals 46 and 54, thereby causing operation of the motor 48. Once the motor 48 is operated, the fan 58 will start to move air through the tube 62. Also, the rollers 94 are being moved against the tube 98 within the chamber 96 which causes liquid 108 to flow through the tube 98 to be dispensed at the sleeve 102. Movement of the trigger 18 will also result in hole 74 partially aligning with external air inlet opening 68 which will permit air to be conducted within the fan housing 60 to be moved by the fan blades 58. Continual movement of the trigger 18 will cause the outer end of wiper bar 118 to wipe across the outer surface 106 creating a film across said opening. The user can then partially release the trigger 18 which will result in the wiper bar 118 to move laterally back across the outer surface 106 and then again activate the trigger 18 which will then cause the outer end of the wiper bar 118 to be moved laterally across the surface 106 to again create film. This movement of the wiper bar 118 back and forth across the outer surface 106 can be repeatedly accomplished by the user by in and out movement of the trigger 18 while the trigger 18 is located in the position continuously operating the motor 48 and the pump 96.

In order to gain access to replace the batteries 34 and 38, there is provided a door 150. The door 150 includes a sleeve 152 which is pivotally mounted on a pin 154 with the pin 154 being integral with the housing 12. The second in series electrical contact 36 is fixedly mounted on the inside surface of the door 150. The outer end of the door 150 includes a locking member 156. The locking member 156 is to be formed of plastic along with the door 150. The member 156 is deflectable into cavity 158 which permits the locking member 156 to lockingly engage with protuberance 160 formed on the housing 12. By manual pressure being applied to the lock member 156, moving such into the cavity 158, the locking member 156 will be disengaged from the protuberance 160 which will permit pivot opening movement of the door 150 to facilitate removal and replacement of the batteries 34 and 38. Once the batteries 34 and 38 have been removed and replaced, it is only necessary to pivot the movement of the door 150 back to the locking position at which time the locking member 156 will automatically deflect by camming action upon coming into contact with the protuberance 160 until the protuberance 160 will again lockingly connect with the locking member 156.

It is to be noted that the wiper bar 118 pivots laterally about a longitudinal center axis whose center length constitutes the main portion of the wiper bar located between the ends of the wiper bar. This longitudinal center axis is located in alignment with and through hole 162 which is located above the sleeve 102. The result is that the wiping action moves back and forth laterally across the outer surface 106 which means that the film created across opening 116 is created from right to left and from left to right. It has been found that such creating of a film creates film more consistently than if it was vertically created, that is from top to bottom or bottom to top. This is important as the film is almost always created each time the wiper bar 118 is moved across the outer surface 106, which means that there will be produced a film across said outer surface 106 in conjunction with each movement of the wiper bar 118 into which air can be blown, thus forming a series of bubbles.

What is claimed is:

1. An improved bubble producing toy comprising:

a housing having an internal chamber;

a dispensing opening formed within said housing and connecting with said internal chamber, said dispensing opening connecting to the ambient, a sleeve mounted within said dispensing opening, said sleeve having a central opening and a dispensing surface;

a reservoir mounted on said housing, said reservoir to contain a liquid, said liquid being capable of producing air bubbles;

a pump mounted on said housing, said pump being connected to said reservoir;

a source of blown air produced within said internal chamber, said source to be dispensed into said central opening of said sleeve into the ambient, said source of said blown air being produced by a fan, said fan being mounted within said internal chamber of said housing, said fan being operated by an electrical motor, said pump being operable to move said liquid to be dispensed at said sleeve, said electrical motor also operating said pump; and a film producing mechanism mounted on said housing, said film producing mechanism including a wiper bar, said wiper bar being located against said dispensing surface, said wiper bar being laterally movable back and forth across said dispensing surface, said liquid from said reservoir to be moved by said pump to said dispensing surface whereby said wiper bar locates a thin film of said liquid across said dispensing surface as said wiper bar is moved laterally across said dispensing surface downstream of air flow from said source flowing through said thin film mounted across said central opening which creates air bubbles.

2. The improved bubble producing toy as defined in claim 1 wherein:

said sleeve having an exterior wall surface which is spaced from said internal chamber forming a plurality of discharge openings surrounding said sleeve, a portion of said blown air from said source to be discharged through said discharge openings into the ambient.

3. The improved bubble producing toy as defined in claim 1 wherein:

a drip rod being mounted within said housing, said drip rod being connected to said sleeve, excess liquid is to be conducted by gravity onto said drip rod into a catching funnel, said catching funnel being located within said internal chamber and connected to said reservoir, any excess liquid is to be caused to flow through said catching funnel back into said reservoir; and there being a one-way valve mounted between said catching funnel and said reservoir that only permits liquid to be conducted from said catching funnel into said reservoir, said one-way valve comprising a ball check valve.

4. The bubble producing toy as defined in claim 1 wherein:

a trigger actuating switch being mounted on said housing, said trigger actuating switch being movable between an activating position and a deactivating position, said trigger actuating switch having a hook member, an electrical contact being continuously biased to electrically connect with said electrical motor, said hook member to be engagable with said electrical contact, with said trigger actuating switch in said deactivating position said electrical contact being spaced from said motor by said hook member causing said motor to not operate, with said trigger actuating switch in said activating position said electrical contact being connected to said electrical motor causing said motor to operate.

5. The improved bubble producing toy as defined in claim 1 wherein:

said fan being mounted within said fan housing, said fan housing having an opening through which external air is to be conducted to be moved by said fan, a volume control mechanism mounted in conjunction with said opening, said volume control mechanism to be movable to vary the volume of flow of external air into said opening.

6. The improved bubble producing toy as defined in claim 5:

a trigger actuating switch being mounted on said housing, said trigger actuating switch being movable between an activating position and a deactivating position, said trigger actuating switch having a hook member, an electrical contact being continuously biased to electrically connect with said electrical motor, said hook member to be engagable with said electrical contact, with said trigger actuating switch in said deactivating position said electrical contact being spaced from said motor by said hook member causing said motor to not operate, with said trigger actuating switch in said activating position said electrical contact being connected to said electrical motor causing said motor to operate.

7. The improved bubble producing toy as defined in claim 6 wherein:

said volume control mechanism being connected to said trigger actuated switch and be movable therewith.

* * * * *